US005794576A

United States Patent [19]

Hara et al.

[11] Patent Number: 5,794,576

[45] Date of Patent: Aug. 18, 1998

[54] ENGINE CYLINDER VALVE CONTROLLING APPARATUS

[75] Inventors: Seinosuke Hara; Nobutaka Hayashi; Seiji Tsuruta, all of Kanagawa; Takanori Sawada, Atsugi, all of Japan

[73] Assignee: Unisia Jecs Corporation, Atsugi, Japan

[21] Appl. No.: 803,518

[22] Filed: Feb. 20, 1997

[30] Foreign Application Priority Data

Feb. 20, 1996 [JP] Japan ..... 8-031996

[51] Int. Cl.[6] ..... F01L 13/00

[52] U.S. Cl. ..... 123/90.16; 123/90.22

[58] Field of Search ..... 123/90.15, 90.16, 123/90.17, 90.22, 90.39, 90.4, 90.44, 90.45

[56]. References Cited

U.S. PATENT DOCUMENTS

| | | | |
|---|---|---|---|
| 5,085,182 | 2/1992 | Nakamura et al. | 123/90.16 |
| 5,143,037 | 9/1992 | Sawamoto | 123/90.16 |
| 5,297,516 | 3/1994 | Hara | 123/90.16 |
| 5,388,552 | 2/1995 | Sugimoto et al. | 123/90.16 |
| 5,529,032 | 6/1996 | Oikawa et al. | 123/90.16 |

FOREIGN PATENT DOCUMENTS 63-82009 5/1988 Japan .

*Primary Examiner*—Weilun Lo

*Attorney, Agent, or Firm*—Foley & Lardner

[57] ABSTRACT

An cylinder valve controlling apparatus comprises a first rocker arm and a second rocker arm cooperating with a middle lift cam and a low lift cam, respectively, to active two cylinder valves arranged for each of the engine cylinders, respectively. The apparatus further comprises a free rocker arm cooperating with a high lift cam. During engine operation at low speeds, the first rocker arm activates one of the cylinder valves in accordance with the profile of the middle lift cam, while the second rocker arm activates the other cylinder valve in accordance with the profile of the low lift cam. During engine operation at middle speeds, a coupling including a first lever establish drive connection between the first and second rocker arms and thus the first and second rocker arms follow the profile of the middle cam. During engine operation at high speeds, with the first-mentioned coupling maintaining the drive connection, another coupling establishes drive connection between the free cam follower and the first rocker arm. Thus, the first and second rocker arms activate the corresponding cylinder valves in accordance with the profile of the high lift cam.

20 Claims, 15 Drawing Sheets

ENGINE CYLINDER VALVE CONTROLLING APPARATUS

BACKGROUND OF THE INVENTION

The present invention relates to an apparatus for controlling cylinder valves for an internal combustion engine.

It is known from JP-A 63-82009 U to arrange a first rocker arm, a first free cam follower, a second rocker arm and a second free cam follower along a common rocker shaft in this order to activate two cylinder valves arranged per each of the engine cylinders. This known cylinder valve controlling apparatus employs a plurality of hydraulic pistons to establish drive connection the adjacent two of the first rocker arm, the first free cam follower, the second rocker arm and the second free cam follower. The first rocker arm, first free cam follower, second rocker arm and second free cam follower cooperate with four different cams with different lifts on a camshaft.

An object of the present invention is to provide a compact cylinder valve controlling device which employs reduced number of pivotal components along and about a rocker arm axis to provide three different combinations of valve lift characteristics of two cylinder valves arranged per each of engine cylinders.

SUMMARY OF THE INVENTION

According to the present invention, there is provided an apparatus for controlling cylinder valves for an internal combustion engine, comprising:

- a first rocker arm pivotal about a rocker arm axis;
- a second rocker arm pivotal about the rocker arm axis;
- a free cam follower pivotal about a free cam follower axis parallel to said rocker arm axis and stationary relative to said first rocker arm;
- a first coupling selectively establishing drive connection between said free cam follower and said first rocker arm; and
- a second coupling selectively establishing drive connection between said first rocker arm and said second rocker arm.

DETAILED DESCRIPTION OF THE INVENTION

Figure 1:
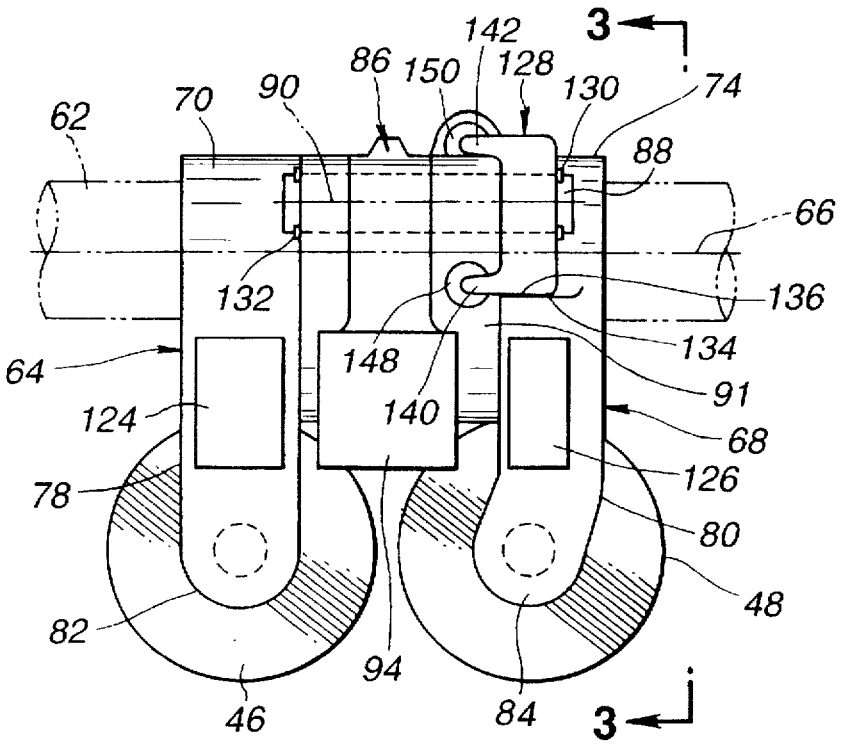
FIG. 1 is a fragmentary top plan view of an internal combustion engine with a camshaft removed to illustrate a pair of cylinder valves arranged for one of the engine cylinders and two rocker arms with a free cam follower of a first embodiment of an apparatus for controlling the cylinder valves according to the present invention.

Referring to the drawings, the present invention is embodied in a control system for an internal combustion engine with a pair of cylinder valves. In the following embodiments, the pair of cylinder valves are intake valves for admission of combustible charge into the cylinder. The present invention may, however, be applied to a pair of cylinder valves serving as exhaust valves for discharge of exhaust gases out of the cylinder.

Referring to FIGS. 1 to 5 and FIG. 11, a first embodiment is described.

Figure 2:
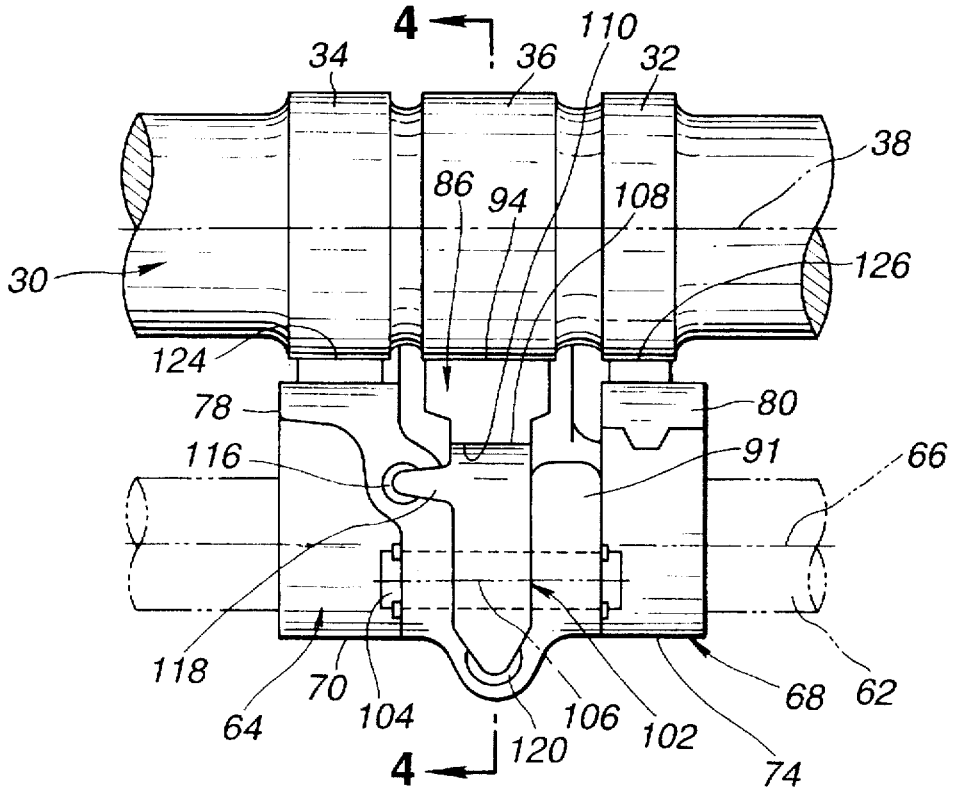
FIG. 2 is a front elevation of the valve controlling apparatus viewing FIG. 1 from the bottom with the cylinder valves removed, illustrating a first lever of a first coupling being in a locked position to establish a bridge structure together with a free cam follower.
Figure 11:
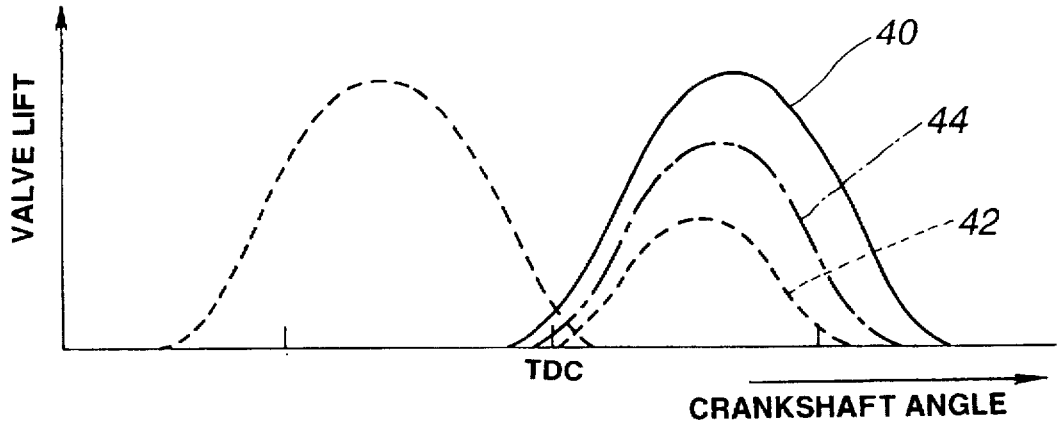
FIG. 11 is a valve lift diagram.
Figure 12:
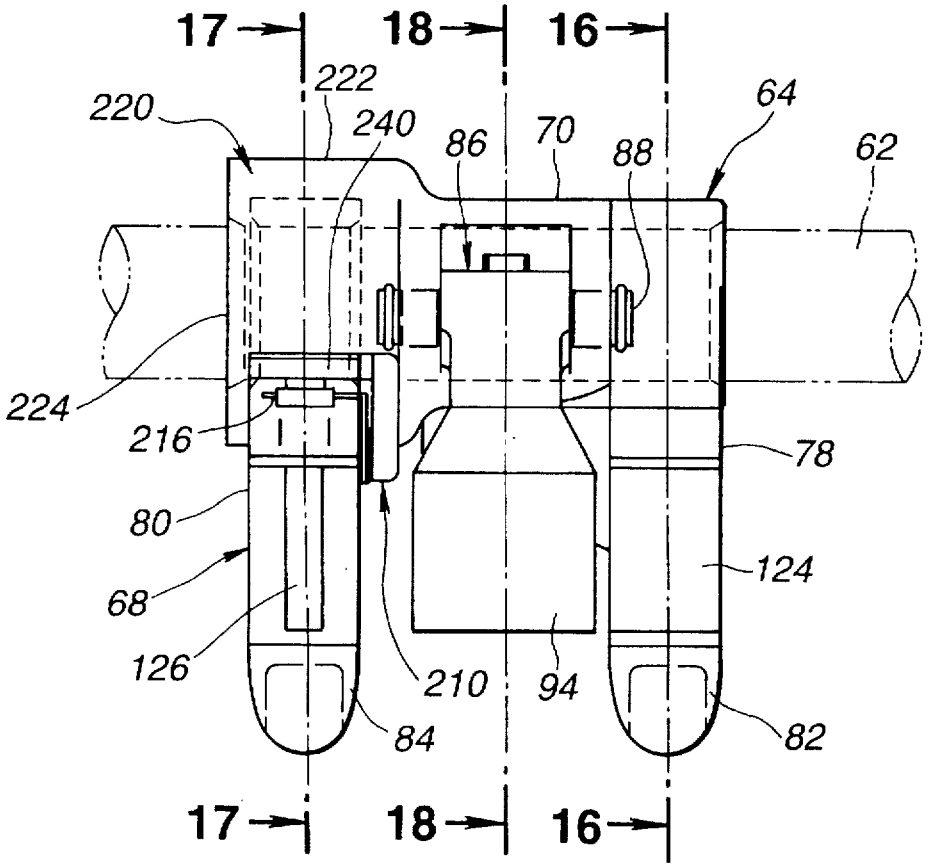
FIG. 12 is a similar view to FIG. 1 illustrating a third embodiment of a valve controlling apparatus with a pair of cylinder valves removed.
Figure 13:
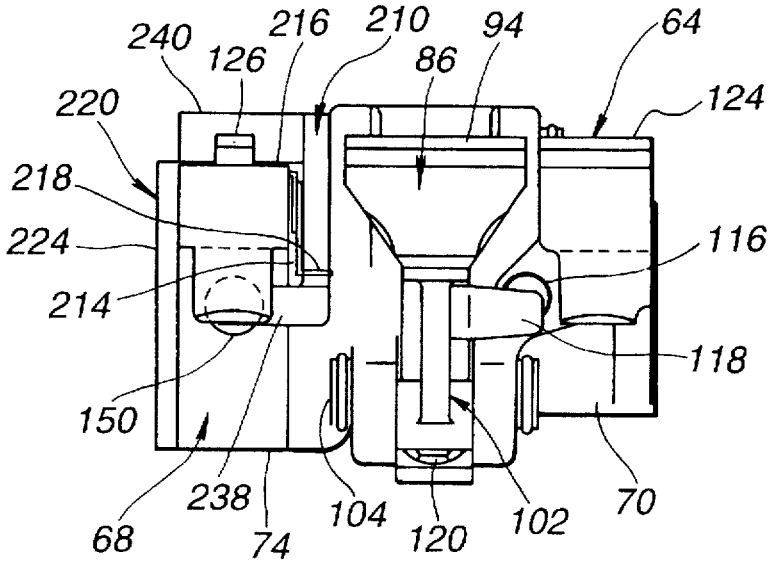
FIG. 13 is a front elevation of the apparatus viewing FIG. 12 from the bottom.
Figure 14:
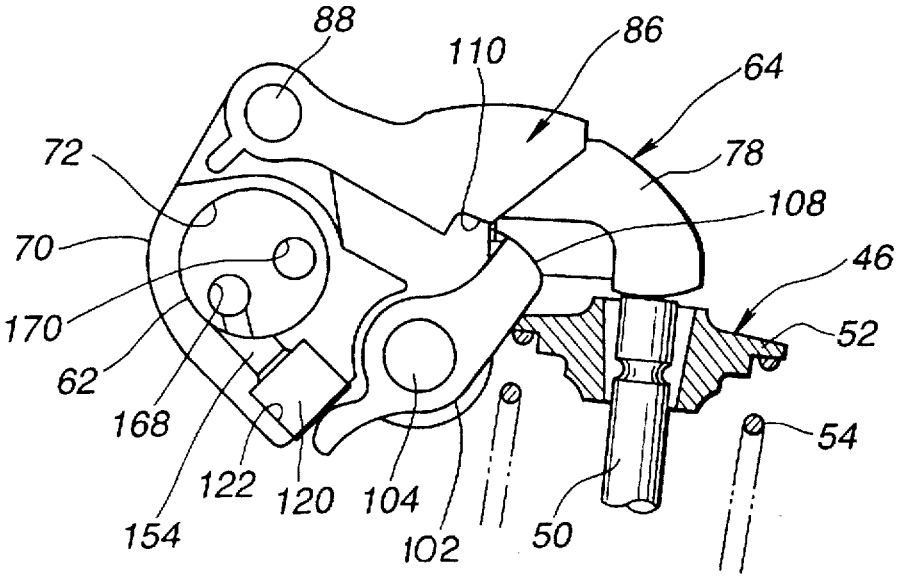
FIG. 14 is a side elevation viewing FIG. 12 from the left with a subordinate or second rocker arm removed to illustrate a main or first rocker arm.

In FIG. 2, the reference numeral 30 designates a camshaft with a plurality, corresponding in number to a plurality of cylinders of the engine, sets of cams. Each set consists of three cams, namely, a low lift cam 32, a middle lift cam 34, and a high lift cam 36. In each set, the high lift cam 36 is disposed between the low and middle lift cams 32 and 34 which are spaced along a camshaft axis 38 of the camshaft 30. Among the three cams 32, 34 and 36 of each set, cam profile of the high lift cam 36 provides the longest valve opening duration and the highest valve lift as illustrated in FIG. 11 by the fully drawn line curve 40, while cam profile of the low lift cam 32 provides the shortest valve opening duration and the lowest valve lift as illustrated in FIG. 11 by the broken line curve 42. As illustrated in FIG. 11 by the one-dot chain line curve 44, cam profile of the middle lift cam 34 provides a valve opening duration shorter than that of the high lift cam 36 but longer than that of the low lift cam 32 and a valve lift lower than that of the high lift cam 36 but higher than that of the low lift cam 32. In other words, the cam profile of the middle lift cam 34 is confined within the cam profile of the high lift cam 36 and the cam profile of the low lift cam 32 is confined within the cam profile of the middle lift cam 34.

Figure 3:
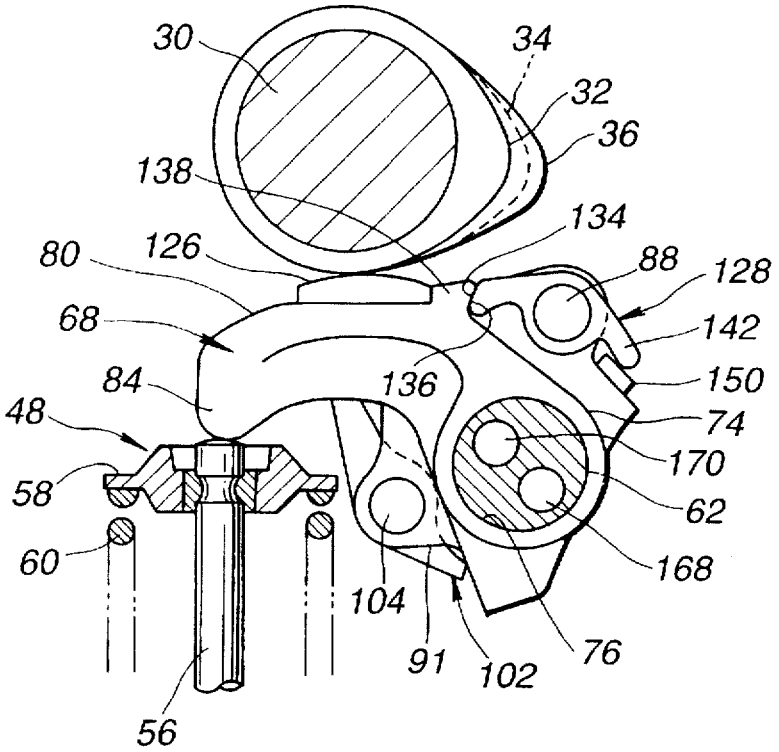
FIG. 3 is a cross section taken through the line 3—3 of FIG. 1.
Figure 4:
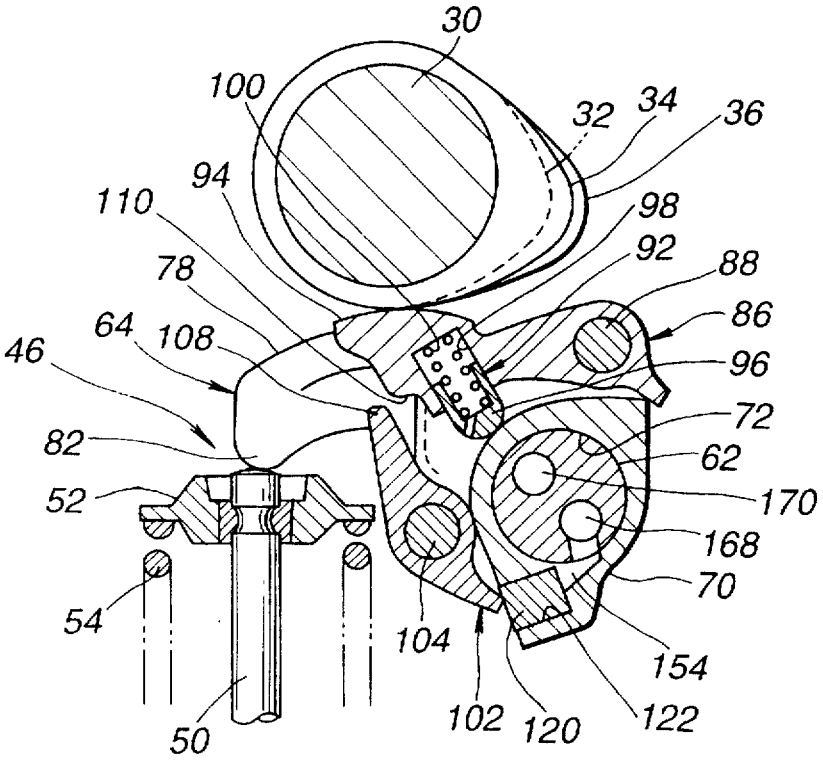
FIG. 4 is a cross section taken through the line 4—4 of FIG. 2 but showing the first lever of the first coupling in a released position from the locked position illustrated in FIG, 2.

In FIG. 1, the reference numerals 46 and 48 designate two cylinder valves in the form of intake valves, namely, a first cylinder valve 46 and a second cylinder valve 48, arranged for one of the engine cylinders. As shown in FIG. 4, the first cylinder valve 46 has a valve stem 50 fixedly carrying a spring retainer 52 for a valve spring 54. The valve spring 54 biases the stem 50 of the cylinder valve 46 in a direction away from the engine cylinder head, not shown, or in an upward direction, viewing in FIG. 4 toward a valve closed position in which a valve head thereof firmly engages a valve seat to close a port surrounded by the valve seat. As shown in FIG. 3, the second cylinder valve 48 has a valve stem 56 fixedly carrying a spring retainer 58 for a valve spring 60. The valve spring 60 biases the stem 56 of the cylinder valve 48 in a direction away from the engine cylinder head, not shown, or in an upward direction, viewing in FIG. 3 toward a valve closed position in which a valve head thereof firmly engages a valve seat to close a port surrounded by the valve seat.

Arranged in parallel to the camshaft axis 38 is a bearing shaft or rocker arm supporting shaft 62 for supporting a first or main rocker arm 64 for pivotal motion about a rocker arm shaft axis 66 and a second or subordinate rocker arm 68 for pivotal motion about the rocker arm shaft axis 66. The first and second rocker arms 64 and 68 are independent and thus can pivot separately. As discussion develops, it becomes clear that the first and second rocker arms 64 and 68 can pivot as a unit.

As may be readily seen from FIGS. 1 and 2, the first rocker arm 64 includes a hub 70 formed with a cylindrical bore 72 (see FIG. 4) which receives the rocker arm shaft 62. Similarly, the second rocker arm 68 includes a relatively short hub 74 as compared to the hub 70. As shown in FIG. 3, the hub 74 is formed with a cylindrical bore 76 receiving the rocker arm shaft 62.

The first rocker arm 64 has an integral wing 78, while the second rocker arm 68 has an integral wing 80. The wing 78 extends from the hub 70 toward the first cylinder valve 46 and has a finger 82 for abutting engagement with the valve stem 50. The wing 80 extends from the hub 74 toward the second cylinder valve 48 and has a finger 84 for abutting engagement with the valve stem 56. Mounted between these wings 78 and 80 is a free cam follower 86 for cooperation with the high lift cam 36. The free cam follower 86 is supported by a bearing shaft 88 for pivotal motion about a free cam follower axis 90 stationary relative to the first rocker arm 64. This cam follower axis 90 is parallel to the rocker arm shaft axis 66 and agrees with the central longitudinal axis of the bearing shaft 88. The bearing shaft 88 is supported by the first rocker arm 64. Specifically, the first rocker arm 64 has a second wing 91 spaced along the rocker arm shaft axis 66 from the first mentioned wing 78 to define between them an accommodating space. The second wing 91 defines one boundary of the first rocker arm 64 adjacent the second rocker arm 68, while the first wing 78 defines the opposite boundary of the first rocker arm 64 remotest from the second rocker arm 68. As shown in FIG. 1, the bearing shaft 88 extends through the accommodating space with one end thereof retained to the first wing 78. The bearing shaft 88 passes through the second wing 91 and projects beyond the boundary of the first rocker arm 64 toward the second rocker arm 68. The projected portion of the bearing shaft 88 extends in spaced relation with the wing 80 of the second rocker arm 68 for the purpose which will be later described.

Referring to FIG. 4, the free cam follower includes a prop 92 resting on the hub 70 of the first rocker arm 64. The prop 92 resiliently biases the free cam follower 86 against the camshaft 30 to keep a rounded bearing surface 94 in contact relation with the high lift cam 36. The prop 92 is retractable to allow pivotal motion of the free cam follower 86, providing a lost motion connection between the free cam follower 86 and the first rocker arm 64. For minimizing interference of the free cam follower 86 with the first rocker arm 64, the free cam follower axis 90 and a site on the hub 70 which the prop 92 rests on are selected such that reaction force imparted to the hub 70 due to retraction of the prop 92 creates substantially no or negligibly small angular moment about the rocker arm shaft axis 66.

The prop 92 includes a plunger 96 received in a bore 98 recessed into the free cam follower 86. A lost motion compression spring 100 is disposed in the bore 98. One end of the lost motion compression spring 100 bears against the bore 98 end, while, the opposite end thereof bears against the plunger 96. With the lost motion spring 100, the plunger 96 continues to rest on the hub 70 during pivotal motion of the free cam follower 86.

Referring to FIGS. 2 and 4, a first lever 102 is supported by a bearing shaft 104 extending across the accommodating space between the first and second wings 78 and 91 of the first rocker arm 64 for pivotal motion about a first lever axis 106. This first lever axis 106 is identical with a longitudinal center line of the bearing shaft 104. As is readily seen from FIG. 2, the bearing shaft 104 has one and opposite ends retained by the first and second wings 78 and 91 of the first rocker arm 64, respectively. As best seen in FIG. 4, the first lever axis 106 and the free cam follower axis 90 are arranged around the hub 70.

The first lever 102 can move clockwise, viewing in FIG. 4 from the illustrated position, to join the free cam follower 86 to establish a bridge structure between the bearing shaft 88 and the bearing shaft 104. After this bridge structure has been established, the free cam follower 86 orbits about rocker arm shaft 62 to cause the first rocker arm shaft 64 to pivot about the rocker arm axis 66 owing to action of the high lift cam 36 on the rounded bearing surface 94 of the free cam follower 86. Under this condition where the first lever 102 is in a locked position (see FIG. 2), the first lever 102 firmly engages at a flat end face 108 thereof with the free cam follower 86 on a mating flat wall 110 thereof. The mating flat wall 110 defines a part of a cutout recessed inwardly of the free cam follower 86 toward the rounded bearing surface 94.

The first lever 102 has a released position as illustrated in FIG. 4. In the released position, the first lever 102 is separated from the free cam follower 86 to allow pivotal motion of the free cam follower 86 about the free cam follower axis 90.

Figure 5:
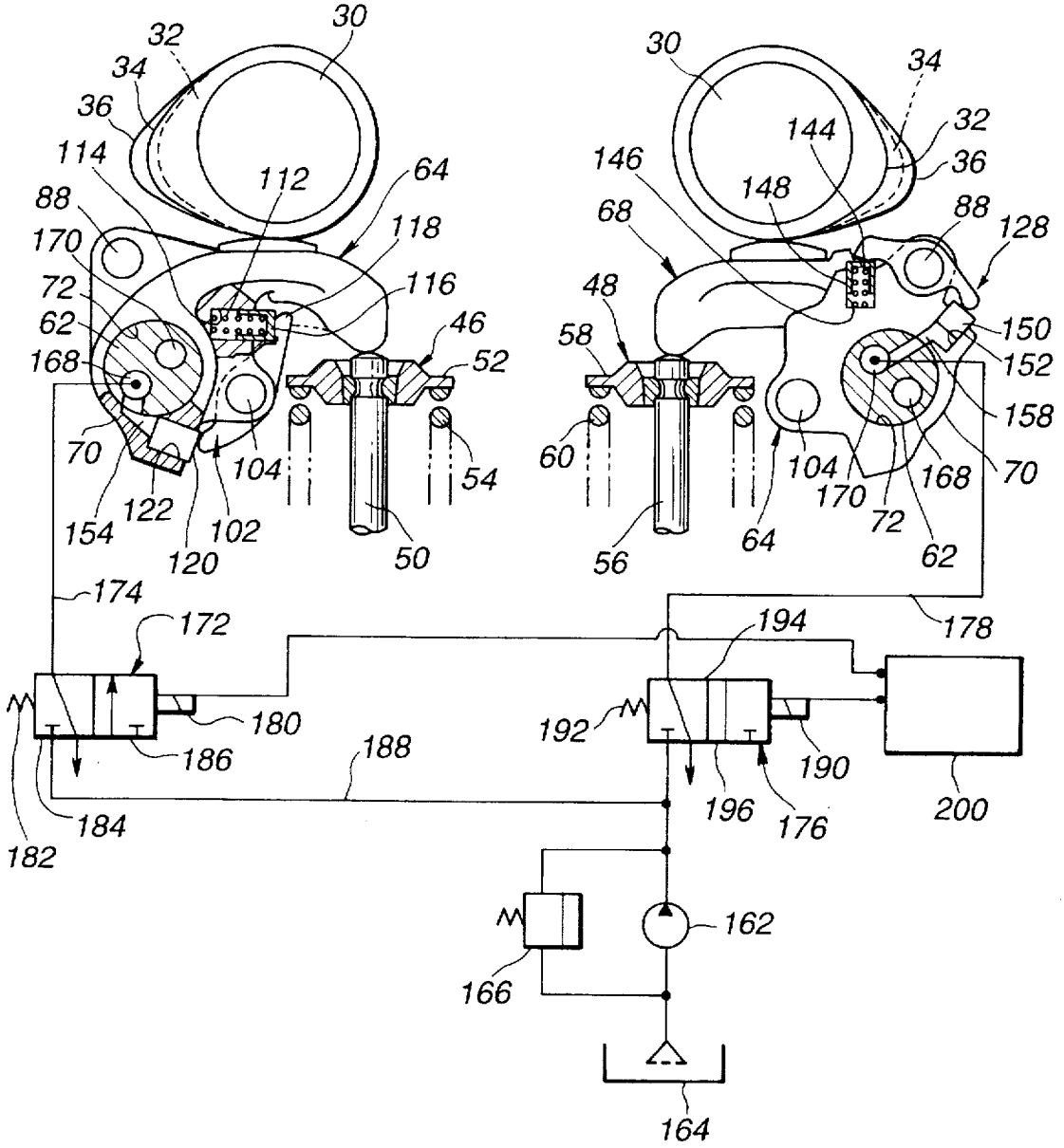
FIG. 5 is a hydraulic circuit of a driver for the first embodiment.
Figure 6:
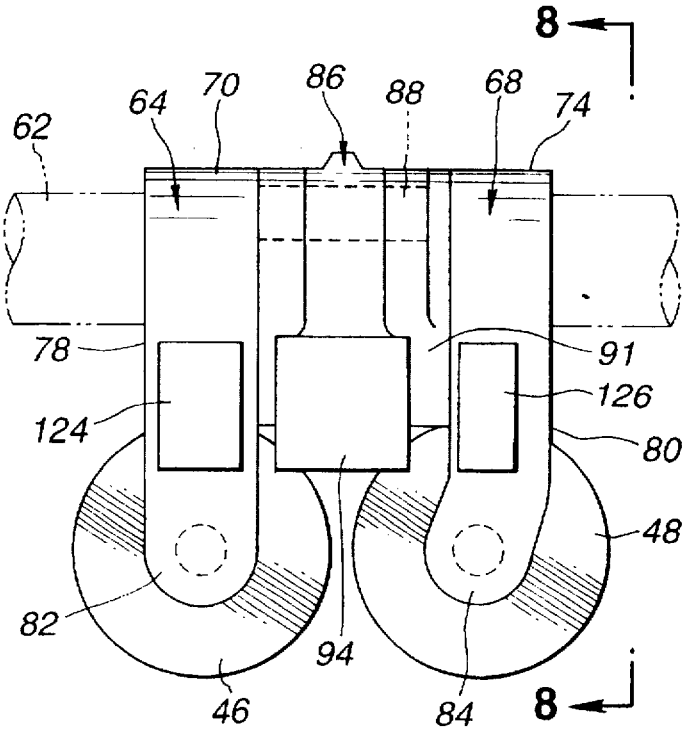
FIG. 6 is a similar view to FIG. 1 illustrating a second embodiment of a valve controlling apparatus.

As shown in FIG. 5, a first compression spring 112 is disposed in a bore 114 recessed into the hub 70 of the first rocker arm 64 at a location adjacent one end of the first lever 102 formed with the flat end face 108. A spring retainer 116 is received in the bore 114. The compression spring 112 acts at one end thereof on the bore 114 end and at the opposite end on the spring retainer 116, thus keeping the spring retainer 116 in contact with a lateral ear 118 (see FIG. 2) of the first lever 102 adjacent the end formed with the flat end face 108. Owing to the action of the spring 112, the first lever 102 is resiliently biased clockwise viewing in FIG. 5 or counterclockwise viewing in FIG. 4. As an actuator for the first lever 102, a hydraulic piston or plunger 120 is disposed in a bore 122 recessed into the hub 70 at a location adjacent the opposite end of the first lever 102 to the end formed with the flat end face 108. The hydraulic piston 120 abuts the first lever 102 at a portion adjacent the above-mentioned opposite end thereof to limit further rotation of the first lever 102, defining the disengaged position (see FIG. 4) of the first lever 102 biased by the spring 112.

Referring back to FIGS. 1 and 2, the first rocker arm 64 has formed on the wing 78 thereof a bearing surface 124 cooperating with the middle lift cam 34, while the second rocker arm 68 has formed on the wing 80 thereof a bearing surface 126 cooperating with the low lift cam 32. With the first lever 102 in the released position as illustrated in FIG. 4, the middle lift cam 34 moves the first rocker arm shaft 64 about the rocker arm axis 66 to push open the cylinder valve 46 against the valve spring 54. If, under this condition, the second rocker arm 68 is independent from the first rocker arm 64, the low lift cam 32 moves the second rocker arm 68 about the rocker arm shaft axis 66 to push open the cylinder valve 48 against the valve spring 60. When the first lever 102 is in the locked position illustrated in FIG. 2, the high lift cam 36 moves the first rocker arm 64 about the rocker arm shaft axis 66 to push open the cylinder valve 46.

There occur modes of engine operation where the cylinder valves 46 and 48 should be opened in exactly the same manner. Thus, it is demanded to selectively provide drive connection between first and second rocker arms 64 and 68. In order to meet this demand, a second lever 128 is provided as shown in FIG. 1 and 3. As best seen in FIG. 1, the second lever 128 is supported by the projected portion of the free cam follower shaft 88 and retained in appropriate position by a snap ring 130 encircling the shaft 88 at a portion adjacent a free end of the projected portion. Another snap ring 132 encircles the shaft 88 at a portion adjacent the opposite end thereof to the free end to engage the wing 78 of the first rocker arm 64. With the snap rings 130 and 132, the shaft 88 is held in axially stationary relative to the first rocker arm 64. FIGS. 1 and 3 show the second lever 128 in a locked position. In the locked position, an end face 134 engages a mating wall 136 with which an elevation 138 is formed. This elevation 138 is integral with the wing 80 of the second rocker arm 68 and the mating wall 136 is displaced in spaced relationship from the shaft 88 supporting the second lever in a direction in which the first rocker arm 64 pivots to push open the cylinder valve 46.

The second lever 128 can pivot from the locked position as illustrated in FIG. 3 about the free cam follower axis 90 counterclockwise to assume a released position, not shown. In the released position, the second lever 128 is separated from the second rocker arm 68, allowing pivotal motion of the second rocker arm 68 under control of the low lift cam 32.

As best seen in FIG. 1, the second lever 128 is formed with a first lateral ear 140 and a second lateral ear 142. The first lateral ear 140 projects from a portion of the second lever 128 adjacent the end face 134 thereof. The second lateral ear 142 projects from a portion of the second lever 128 from a portion adjacent the opposite end to the end formed with the end face 134. The second lever 128 excluding the first and second lateral ears 140 and 142 is disposed within a space defined between two radial planes, with respect to the rocker arm shaft axis 66, which define axial limits of the second rocker arm 68, respectively. The first and second lateral ears 140 and 142 extend into a space defined between two radial planes, with respect to the rocker arm shaft axis 66, which define axial limits of the second wing 91 of the first rocker arm 64.

As shown in FIG. 5, a second compression spring 144 is disposed in a bore 146 recessed into the second wing 91 at a location adjacent the first lateral ear 140 of the second lever 128. A spring retainer 148 is received in the bore 146. The compression spring 144acts at one end thereof on the bore 146 end and at the opposite end on the spring retainer 148, thus keeping the spring retainer 148 in contact with the first lateral ear 140 of the second lever 128. Owing to the action of the spring 144, the second lever 128 is resiliently biased clockwise viewing in FIGS. 5 and 3. As an actuator for the second lever 128, a hydraulic piston or plunger 150 is disposed in a bore 152 recessed into the hub 70 at a location adjacent the second lateral ear 142 of the second lever 128. The hydraulic piston 150 abuts the second lateral ear 142 to limit further rotation of the second lever 128, defining the released position of the second lever 128 biased by the spring 144.

FIG. 5 illustrates a preferred implementation of a driver for the first and second levers 102 and 128.

The driver includes the first and second hydraulic pistons 120 and 150. Although not specifically illustrated in FIGS. 4 and 5, the first hydraulic piston 120 defines within the bore 122 a hydraulic fluid pressure chamber to which a hydraulic fluid passage 154 is open at one end thereof. At the other end, the passage 154 is open to the cylindrical bore 72 of the first rocker arm 64 in which the rocker arm shaft 62 is received. Similarly, the second hydraulic piston 150 defines within the bore 152 a hydraulic fluid pressure chamber connected to a hydraulic fluid passage 158 which is open to the cylindrical bore 72 of the first rocker arm 64. As hydraulic fluid pressure in the hydraulic fluid chamber increases, the corresponding one of the first and second levers 102 and 128 is urged to move from released position thereof to the locked position thereof.

The driver includes a first hydraulic circuit fluidly disposed between the bore 122 for the first hydraulic piston 120 and a source of hydraulic fluid pressure. The source of hydraulic fluid pressure includes a pump 162 driven by the engine, a hydraulic fluid reservoir 164, and a pressure regulator 166. The driver also includes a second hydraulic fluid circuit fluidly disposed between the bore 152 for the second hydraulic piston 150 and the source of hydraulic fluid pressure.

The first hydraulic circuit includes the passage 154 connected to the bore 122, and a first axial passage 168 with which the first rocker arm 64 is formed. The second hydraulic fluid circuit includes the passage 158 connected to the bore 152, and a second axial passage 170 with which the second rocker arm 64 is formed. The first and second axial passages 168 and 170 are independent from each other. For establishing fluid communication between the first axial passage 168 and the passage 154, the rocker arm shaft 62 is formed with a peripheral groove and a radial passage providing fluid communication between this peripheral groove and the first axial passage 168. The peripheral groove is long enough to keep fluid communication with the passage 154 during pivotal motion of the first rocker arm 64 relative to the rocker arm shaft 62. For establishing fluid communication between the second axial passage 170 and the passage 158, the rocker arm shaft 62 is formed with a peripheral groove and a radial passage providing fluid communication between this peripheral groove and the second axial passage 170. This peripheral groove is long enough to keep fluid communication with the passage 158 during pivotal motion of the first rocker arm 64 relative to the rocker arm shaft 62. The first axial passage 168 is fluidly connected to an outlet port of a first solenoid operable valve 172 via a hydraulic fluid line diagrammatically illustrated at 174. Similarly, the second axial passage 170 is fluidly connected to an outlet port of a second solenoid operable valve 176 via a hydraulic fluid line diagrammatically illustrated at 178.

The first solenoid operable valve 172 has a solenoid 180 and a return spring 182. When the solenoid 180 is not energized, the first solenoid operable valve 172 assumes a spring set fluid discharge position 184, while, when the solenoid 180 is energized, the first solenoid operable valve 172 assumes a fluid supply position 186. In the fluid discharge position 184, the hydraulic fluid line 174 is connected to a drainage 188 to discharge hydraulic fluid from the bore 122, allowing the spring 112 to set the first lever 102 in the released position thereof with the hydraulic piston 120 recessed into the bore 122. In the supply position 186, the hydraulic fluid line 174 is connected to the pressure regulator valve 166 to supply hydraulic fluid to the bore 122, urging the hydraulic piston 120 to move the first lever 102 against the spring 112 toward the locked position thereof.

The second solenoid operable valve 176 has a solenoid 190 and a return spring 192. When the solenoid 190 is not energized, the second solenoid operable valve 176 assumes a spring set fluid discharge position 194, while, when the solenoid 190 is energized, the second solenoid operable valve 176 assumes a fluid supply position 196. In the fluid discharge position 194, the hydraulic fluid line 178 is connected to drainage 188 to discharge hydraulic fluid from the bore 152, allowing the spring 144 to set the second lever 128 in the released position thereof with the hydraulic piston 150 recessed into the bore 152. In the supply position 196, the hydraulic fluid line 178 is connected to the pressure regulator valve 166 to supply hydraulic fluid to the bore 152, urging the hydraulic piston 150 to move the second lever 128 against the spring 144 toward the locked position thereof.

The solenoids 180 and 190 are energized in response to control signals, respectively. A control unit 200 inputs information of engine speed from output of a crankshaft angle sensor, not shown, and information of engine load from output of a throttle opening degree sensor, not shown, or amount of base fuel injection, compares the input pieces of information with predetermined criteria, and develops the control signals in response to the result of such comparison.

During engine operation at low speeds, the solenoids 180 and 190 are not energized. Under this condition, the middle lift cam 34 lifts the cylinder valve 46 via the first rocker arm 64, while the low lift cam 32 lifts the other cylinder valve 48 via the second rocker arm 68. The free cam follower 86 pivots in accordance with profile of the high lift cam 36. This pivotal motion does not have any influence on pivotal motion of the first rocker arm 64 in accordance with the profile of the middle lift cam 34 due to the action of the lost motion compression spring 100. Variation of valve lift of the cylinder valve 46 due to the middle lift cam 34 is illustrated in FIG. 11 by curve 44. Variation of valve lift of the cylinder valve 48 due to the low lift cam 32 is illustrated in FIG. 1 by curve 42. Activating the cylinder valves 46 and 48 in this manner causes intake air to swirl in the cylinder, thus making contribution to improved combustion in power stroke.

In response to a shift from engine operation at low speeds to engine operation at middle or intermediate speeds, the control unit 200 applies the control signal to the solenoid 190 to energize same. When the solenoid 190 is energized, the solenoid operable valve 176 assumes the fluid supply position 196, allowing supply of hydraulic fluid to the bore 152, causing a pressure build-up therein. This causes the hydraulic piston 150 to turn the second lever 128 against the bias of the spring 144 toward the locked position, bringing the end face 134 into engagement with the mating wall 136 of the second rocker arm 68. As a result, the second rocker arm 68 is brought into unitary motion with the first rocker arm 64. Thus, both the first and second rocker arms 64 and 68 pivot as a unit to lift both of the cylinder valves 46 and 48 in accordance with the profile of the middle lift cam 34.

In response to a shift from engine operation at middle speeds to engine operation at high speeds, the control unit 200 applies the control signal to the solenoid 180 of the first solenoid operable valve 172, too, to energize same. When the solenoid 180 is energized, the solenoid operable valve 172 assumes the fluid supply position 186, allowing supply of hydraulic fluid to the bore 122, causing a pressure build-up therein. This causes the hydraulic piston 120 to turn the first lever 102 against the bias of the spring 112 toward the locked position thereof, bringing the end face 108 into engagement with the mating wall 110 of the free cam follower 86. As a result, the first rocker arm 64 is brought into unitary motion with the free cam follower 86 cooperating with the high lift cam 36. Thus, both the first and second rocker arms 64 and 68 pivot as a unit to lift both of the cylinder valves 46 and 48 in accordance with the profile of the high lift cam 36. Variation of valve lift of each of the cylinder valves 46 and 48 is illustrated in FIG. 11 by curve 40.

In response to a shift from engine operation at high speeds to engine operation at middle speeds, the solenoid 180 of the first solenoid operable valve 172 is de-energized, allowing the return spring 182 to set the discharge position 184, discharging hydraulic fluid from the bore 122. This causes the hydraulic piston 120 to allow the spring 112 to turn the first lever 102 toward the released position thereof. Thus, the cylinder valves 46 and 48 are lifted in accordance with the profile of the middle lift cam 34.

In response to a shift from engine operation at middle speeds to engine operation at low speeds, the solenoid 190 of the second solenoid operable valve 176 is de-energized, too, allowing the return spring 192 to set the discharge position 194, discharging hydraulic fluid from the bore 152. This causes the hydraulic piston 150 to allow the spring 144 to turn the second lever 128 toward the released position thereof. Thus, the cylinder valve 46 is lifted in accordance with the profile of the middle lift cam 34, while the cylinder valve 48 is lifted in accordance with the profile of the low lift cam 32.

As readily seen from FIG. 3, during operation with the second lever 128 in the locked position thereof, the first rocker arm 64 is subject to reaction of the valve spring 60. Let us now consider force acting on the shaft 88 supporting the second lever 128. A vector of this force can be divided into a tangential force component vector with respect to an imaginary circle which is drawn with its center placed on the rocker arm shaft axis 66 and intersects the free cam follower axis 90 and a radial force component with respect to this imaginary circle. Preferably, the setting is such that the elevation and angle of the mating wall 136 with respect to the free cam follower axis 90 induces a radial force component vector directed radially inwardly toward the center of the above-mentioned imaginary circle. This arrangement is effective in suppressing undesired motion of the first rocker arm 64 which otherwise might be induced owing to clearance between the rocker arm shaft 62 and the first rocker arm 64.

According to the first embodiment previously described, the second lever 128 is supported by the shaft 88 for the free cam follower 86 for pivotal motion about the free cam follower axis 90 for cooperation with the second rocker arm 68. More space saving arrangement of the second lever 128 is proposed according to a second embodiment illustrated in FIGS. 6 to 10.

The second embodiment is substantially the same as the first embodiment except the arrangement of a second lever. For ease of comparison with the first embodiment and simplicity of description, the same reference numerals as used in FIGS. 1 to 5 are used to designate like or similar parts or portions illustrated in FIGS. 6 to 10.

Figure 7:
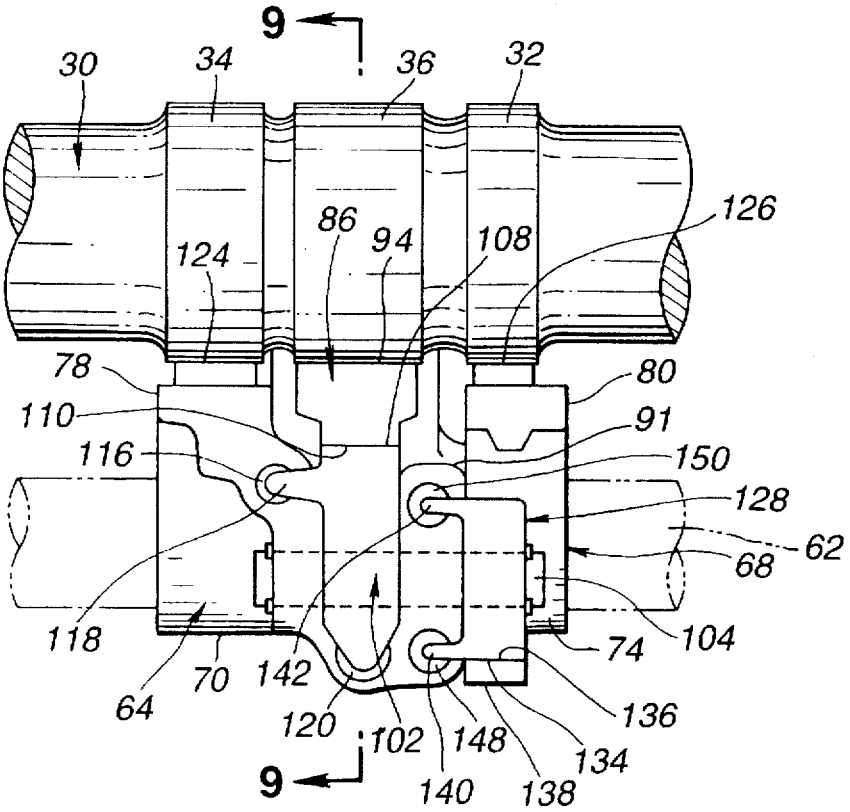
FIG. 7 is a front elevation of the apparatus viewing FIG. 6 from the bottom with cylinder valves removed.
Figure 8:
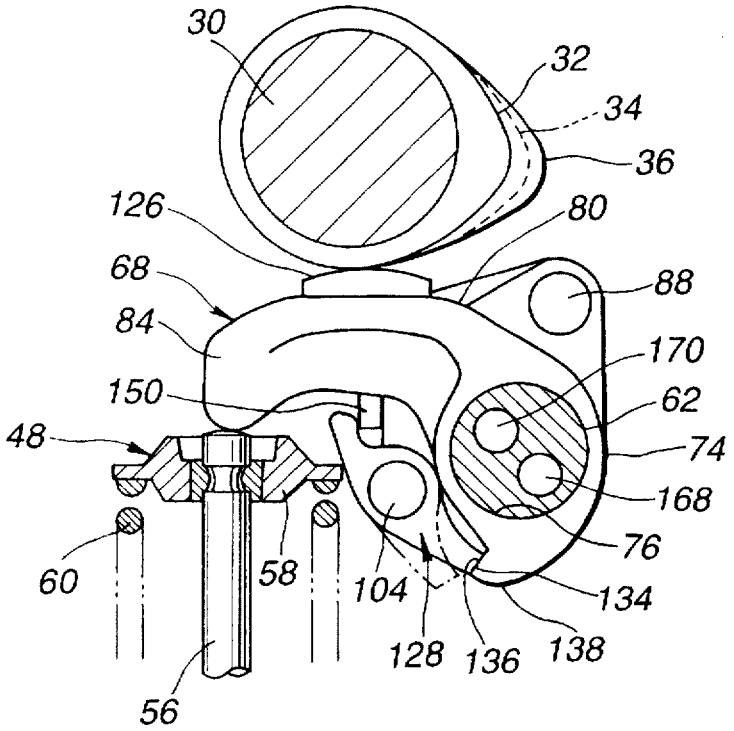
FIG. 8 is a cross section taken though the line 8—8 of FIG. 6.
Figure 9:
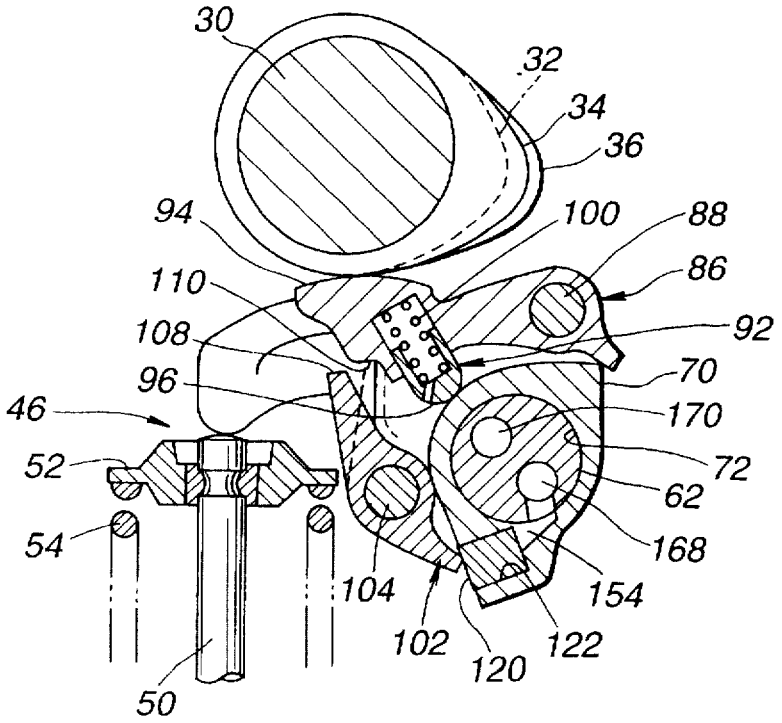
FIG. 9 is a cross section taken through the line 9—9 of FIG. 7.
Figure 10:
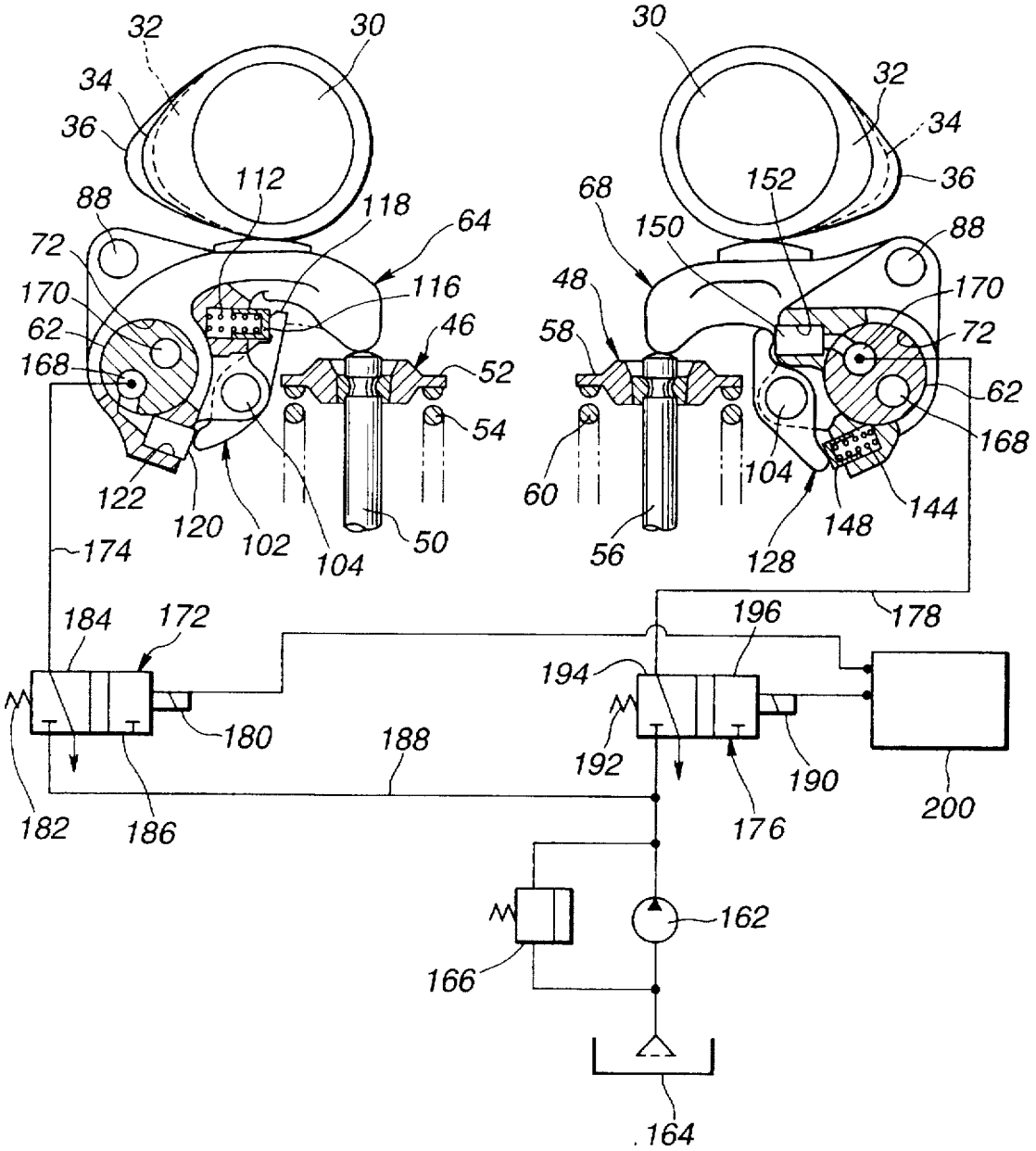
FIG. 10 is a hydraulic circuit of a driver for the second embodiment.

In FIGS. 7 and 8, a second lever 128 of the identical construction with its counterpart in the first S embodiment is supported by a bearing shaft 104 for a first lever 102. Comparing FIG. 8 with FIG. 3 reveals that an integral elevation 138 of a second rocker arm 68 is displaced about a rocker arm shaft axis 66 more than 180 degrees from its counterpart of the first embodiment. The integral elevation 138 has a wall 136 mating with an end face 134 of the second lever 128.

This arrangement of the second lever 128 is advantageous in the case where little space is available between a camshaft 30 and first and second rocker arms 64 and 68.

FIGS. 12 to 25 illustrate a third embodiment according to the present invention. This third embodiment is substantially the same as the first and second embodiments except the arrangement of a second lever. In the previously described first and second embodiments, the second lever 128 is supported via the shaft 88 (see FIG. 1) or 104 by the first rocker arm 64. In other words, both the first and second levers 102 and 128 are assembled with the first rocker arm 64. In the third embodiment hereinafter described, the first and second levers are supported by the first and second rocker arms, respectively. More specifically, in the first and second embodiments, the second lever 128 on the first rocker arm 64, when in the locked position thereof, presses the mating wall 136 of the integral elevation 138 of the second rocker arm 68 during pivotal motion of the first rocker arm 64 to open the cylinder valves 46 and 48. In the third embodiment, when the second lever is in the locked position in which an end face thereof engages a mating wall with which the first rocker arm is formed, the mating wall on the first rocker arm presses the second lever on the second rocker arm during pivotal motion of the first rocker arm to open cylinder valves.

Although, in the third embodiment, the same reference numerals as used in the first embodiment are used to designate like or similar parts or portions, the second lever and a spring biasing the second lever are designated by new reference numerals, respectively. This is because, the second lever and the spring used in the third embodiment are different in design from their counterparts, namely, the second lever 128, compression spring 144 and spring retainer 148.

Figure 15:
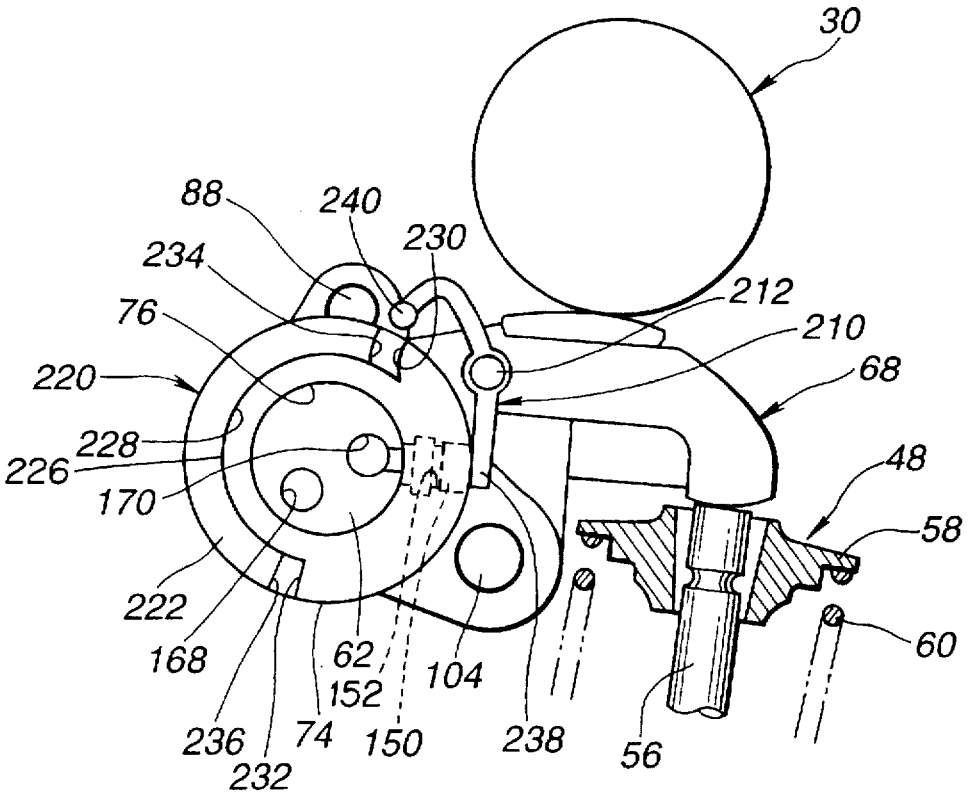
FIG. 15 is a side elevation viewing FIG. 12 from the left to illustrate the second rocker arm with a camshaft.

As best seen in FIG. 15, a second rocker arm 68 has a hub 74 with a bore 152 for a hydraulic piston 150 serving as an actuator of a second lever 210. The second lever 210 is supported by a shaft or pin 212 projecting from a wing 80 toward a first rocker arm 64. For biasing the second lever 210 toward a released position as illustrated in FIG. 15, a spiral spring 214 is mounted around the pin 212. The spiral spring 214 has opposite legs 216 and 218. At the one leg 216, the spiral spring 214 is anchored to the second rocker arm 68 on the hub 74, and at the opposite leg 218, the spiral spring 214 is anchored to the second lever 210, biasing the second lever 210 clockwise viewing in FIG. 15. In FIG. 15, the released position of the second lever 210 is illustrated by the fully drawn line.

The first rocker arm 64 has a housing 220 integral with the hub 70. The housing 220 includes a collar 222 and an end plate 224 spaced by the collar 222 from and opposed to an enlarged axial end of the hub 70. The collar 222 interconnects the end plate 224 and the hub 70 to define a cavity partially receiving the hub 74 of the second rocker arm 68.

Figure 20:
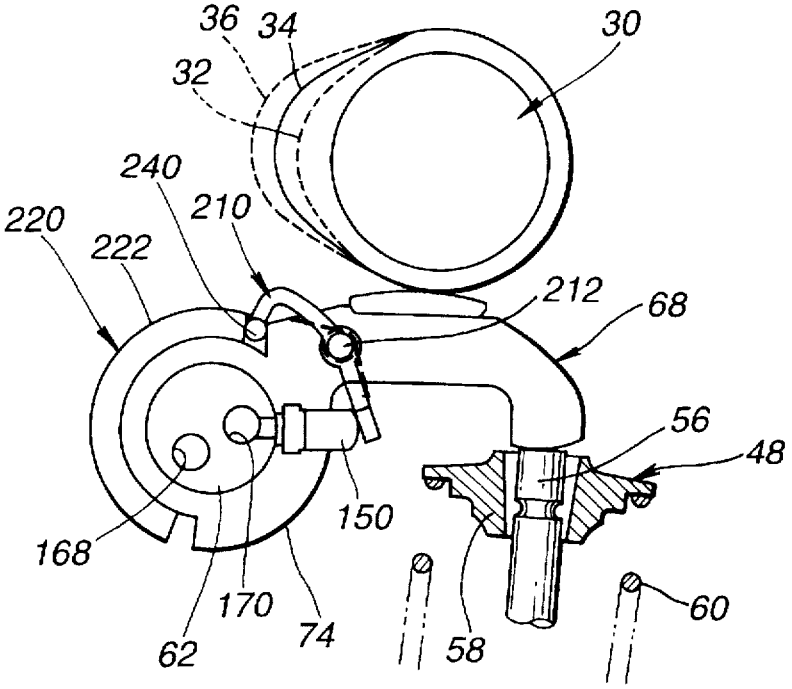
FIG. 20 is a similar view to FIG. 17 illustrating the second rocker arm brought into unitary motion with the first rocker arm under the control of the middle lift cam.
Figure 23:
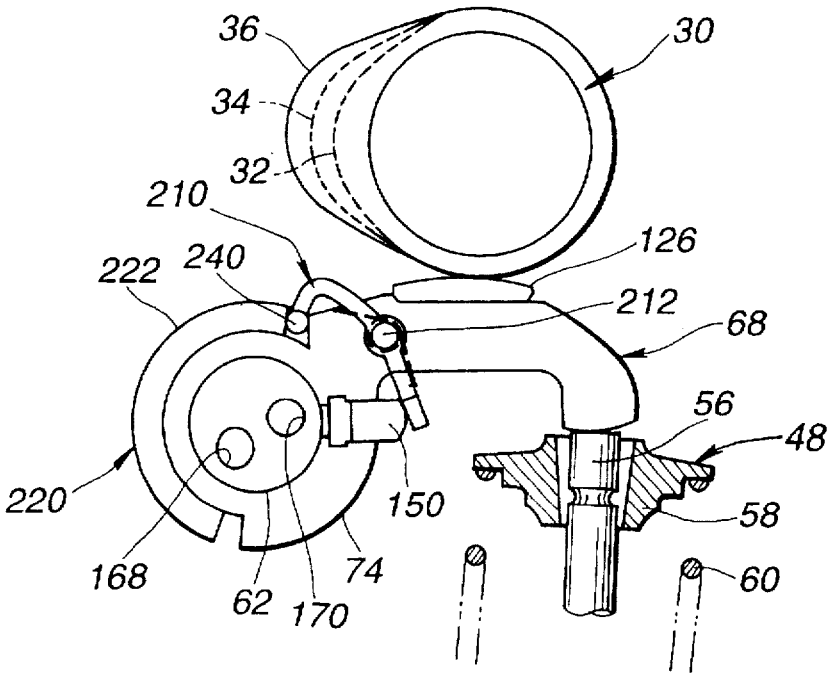
FIG. 23 is a similar view to FIG. 17 illustrating the second rocker arm brought into unitary motion with the first rocker arm that is brought into unitary motion with the free cam follower cooperating with the high lift cam.

The hub 74 is recessed to define a cylindrical surface 226 opposed to and cooperating with a cylindrical wall 228 of the collar 222. The cylindrical wall 228 define a part of the cavity of the housing 220. The cylindrical surface 226 extends between a first shoulder 230 and a second shoulder 232. These shoulders 230 and 232 are spaced from a first end 234 and a second end 236 of the collar 222 long enough to permit free movement of the collar 222 relative to the hub 74 during pivotal motion of the first rocker arm 64 relative to the second rocker arm 68. As best seen in FIG. 15, the first shoulder 230 is rounded to allow smooth shift of the second lever 210 into a locked position thereof as illustrated in FIGS. 20 and 23.

The second lever 210 has at one end an ear 238 engaged by the hydraulic piston 150. Extending from the opposite end of the second lever 210 is a bolt 240 arranged to engage the first end 234 of the collar 222 when the second lever 210 is in the locked position thereof.

Touching on a gap between the first shoulder 230 and the first end 234 of the collar 222, the gap is wide enough to allow entry of the bolt 240 when both of cylinder valves 46 and 48 are at rest to take closed positions, but it is narrowed during pivotal motion of the first rocker arm 64 relative to the second rocker arm 68 to lift open the cylinder valves 46 and 48. The relationship between the first end 234 of the collar 222 and the bolt 240 of the second lever 210 should be such that, when, in the locked position of the second lever 210, the bolt 240 is received in the gap, the first end 234 of the collar 222 comes into engagement with the bolt 240 to urge the second lever 210 to move the second rocker arm 68 in unison with pivotal motion of the first s rocker arm 64.

Figure 16:
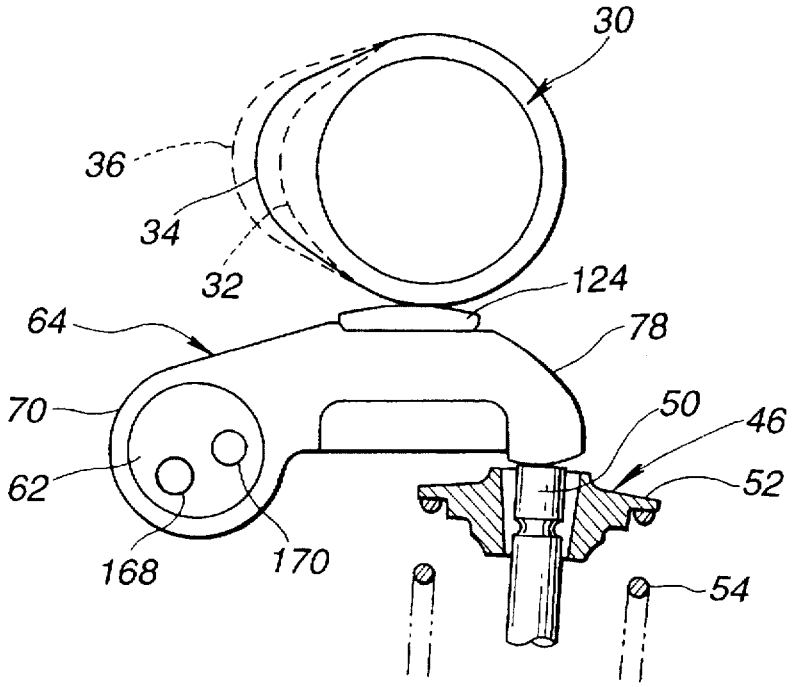
FIG. 16 is a cross section taken through the line 16—16 of FIG. 12 illustrating the first rocker arm under the control of a middle lift cam of the camshaft.
Figure 17:
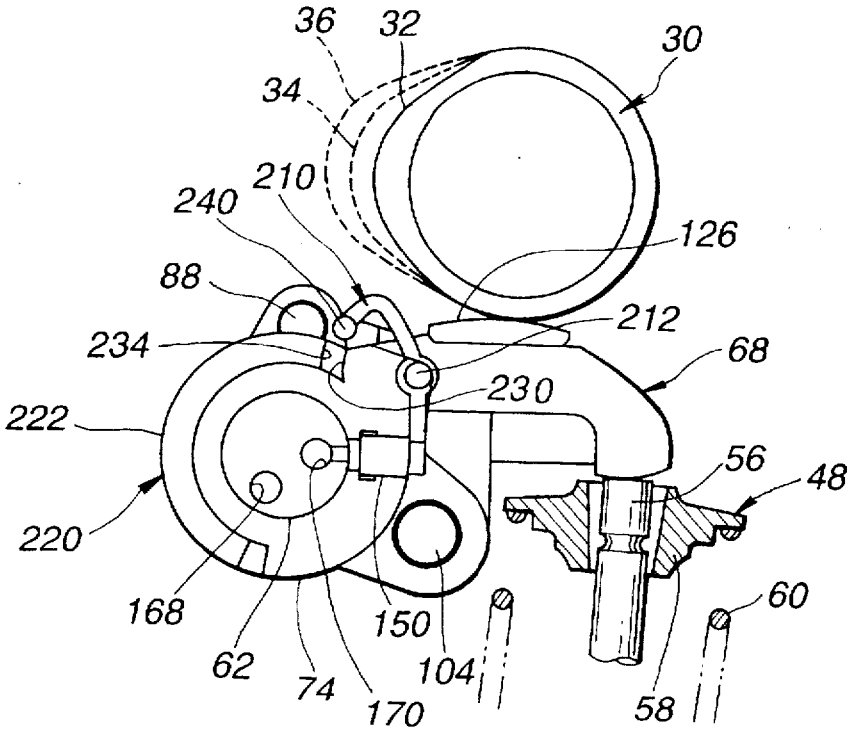
FIG. 17 is a cross section taken through the line 17—17 of FIG. 12 illustrating the second rocker arm under the control of a low lift cam of the camshaft.
Figure 18:
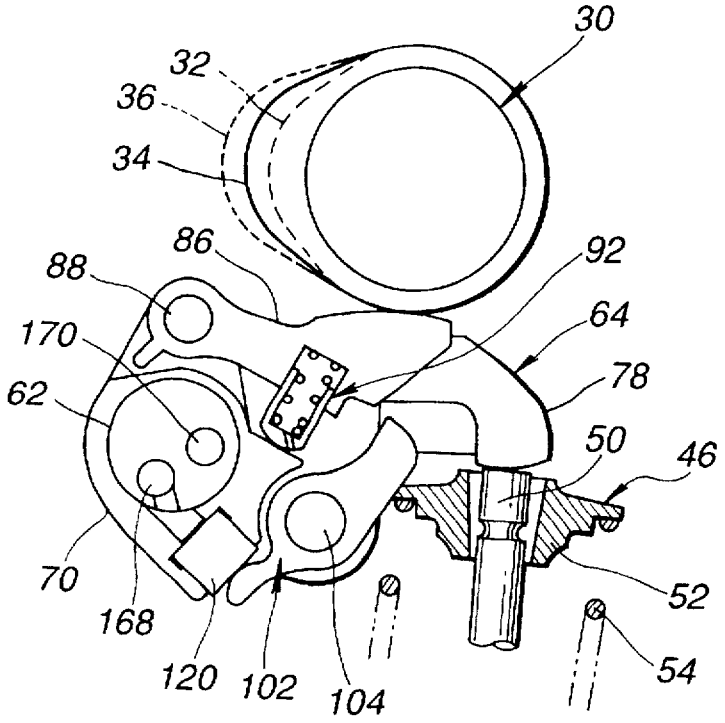
FIG. 18 is a cross section taken though the line 18—18 of FIG. 12 illustrating a free cam follower under the control of a high lift cam.

FIGS. 16, 17 and 18 illustrate position of parts during engine operation at low speeds. As seen from FIG. 17, the second lever 210 is in the released position so that the second rocker arm 68 is independent from the first rocker arm 64.

Figure 19:
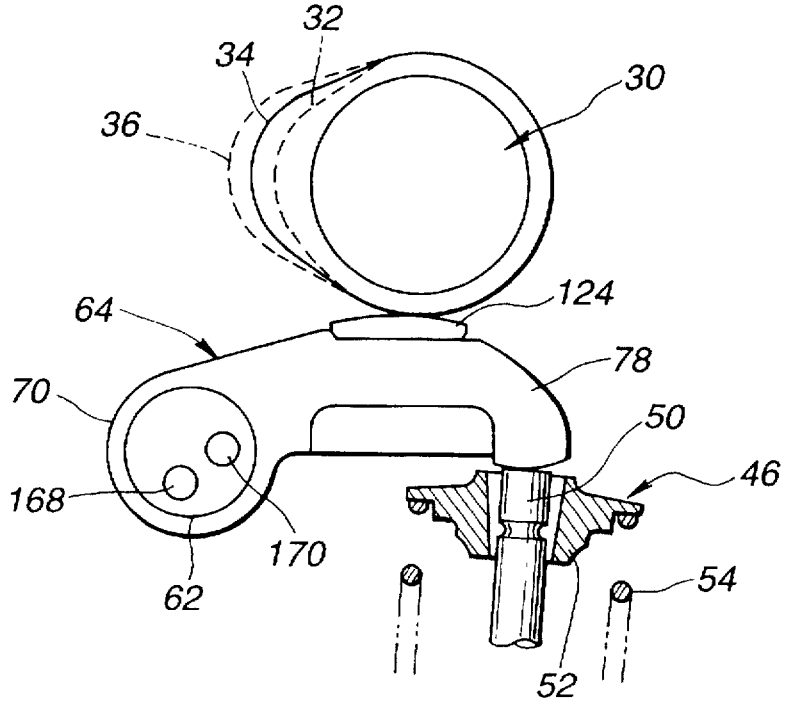
FIG. 19 is a cross section similar to FIG. 16 illustrating the first rocker arm under the control of the middle lift cam.
Figure 21:
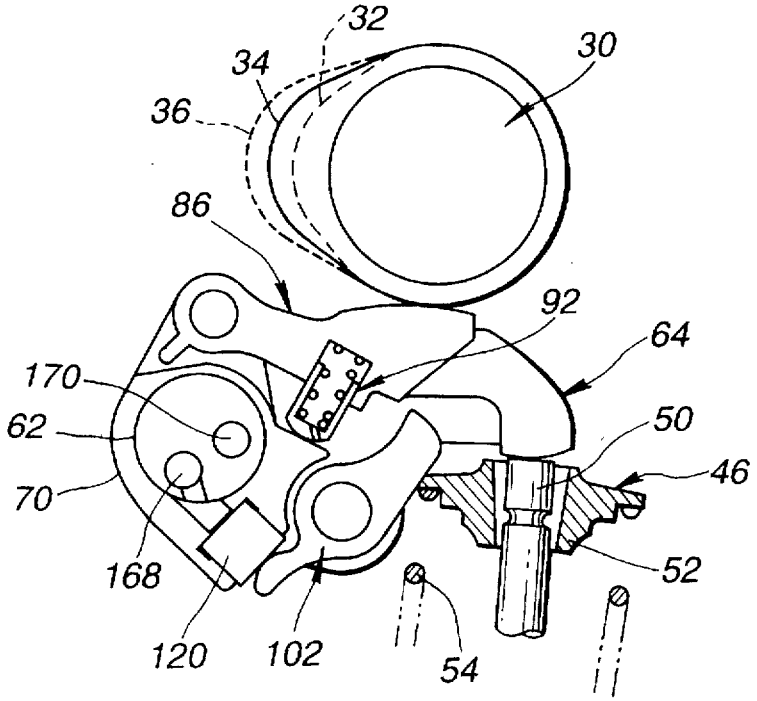
FIG. 21 is a similar view to FIG. 18 illustrating the free cam follower under the control of the high lift cam.

FIGS. 19, 20 and 21 illustrate position of parts during engine operation at middle speeds. As seen from FIG. 20, the second lever 210 is in the locked position with the bolt 240 received in the gap between the first end 234 of the collar 222 and the first shoulder 230 of the hub 74. Since the cylinder valves 46 and 48 are at rest to take valve closed positions, the first end 234 of the collar 222 is about to engage the bolt 240. Under this condition, both the first and second rocker arms 64 and 68 pivot as a unit. Since the first lever 102 is in the released position as illustrated in FIG. 21, both of the first and second rocker arms 64 and 68 follow a middle lift cam 34 to activate the cylinder valves 46 and 48 in accordance with the profile of the middle lift cam 34.

Figure 22:
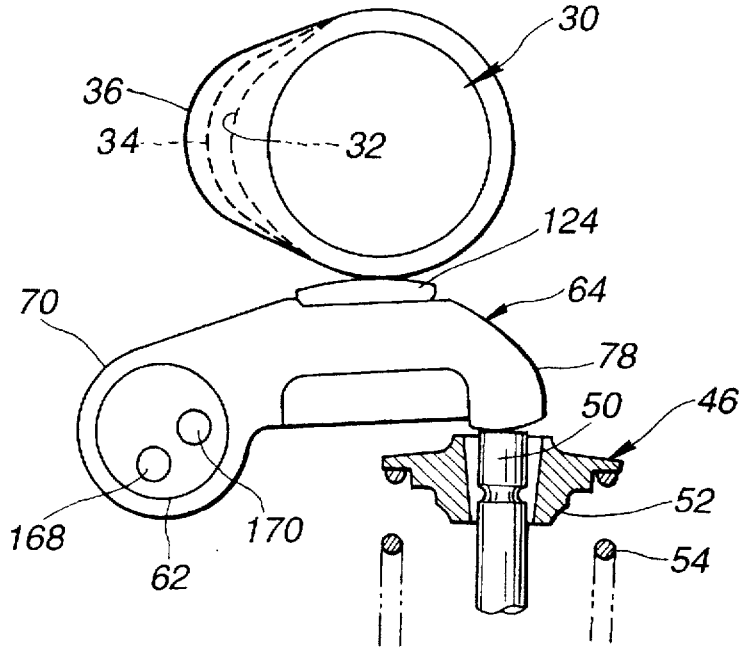
FIG. 22 is a similar view to FIG. 16 illustrating the first rocker arm brought into unitary motion with the free cam follower cooperating with the high lift cam.
Figure 24:
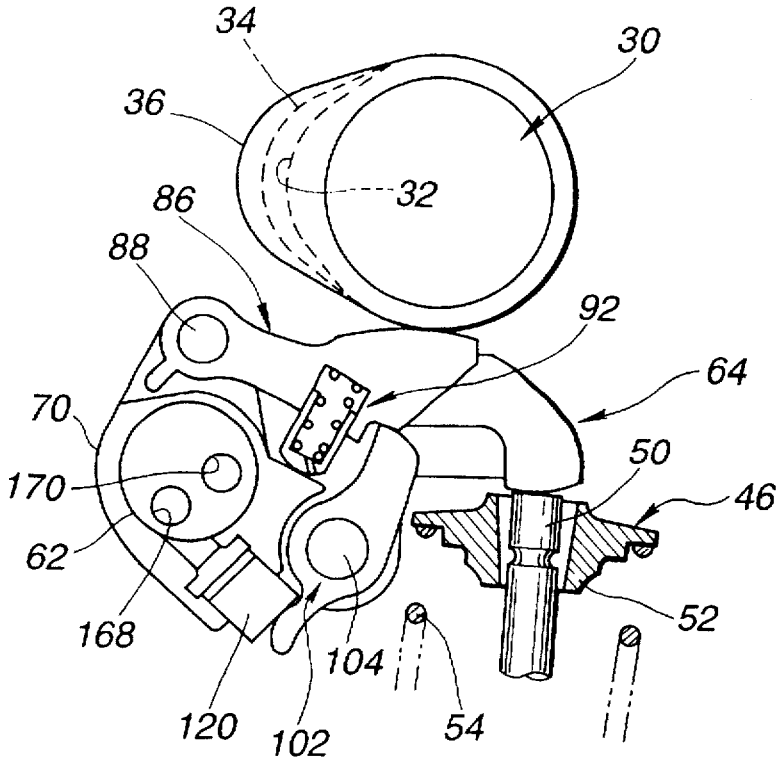
FIG. 24 is a similar view to FIG. 18 illustrating the free cam follower under the control of the high lift cam.

FIGS. 22, 23 and 24 illustrate engine operation at high speeds. As is readily seen from FIG. 23, the second lever 210 is in the locked position and the second rocker arm 68 pivots in unison with the first rocker arm 64. Since, with the first lever 102 in the locked position (see FIG. 21), a free cam follower 86 has become an integral part of the first rocker arm 64, both the first and second rocker arms 64 and 68 follow a high lift cam 36 to activate the cylinder valves 46 and 48 in accordance with the profile of the high lift cam 36.

Figure 25:
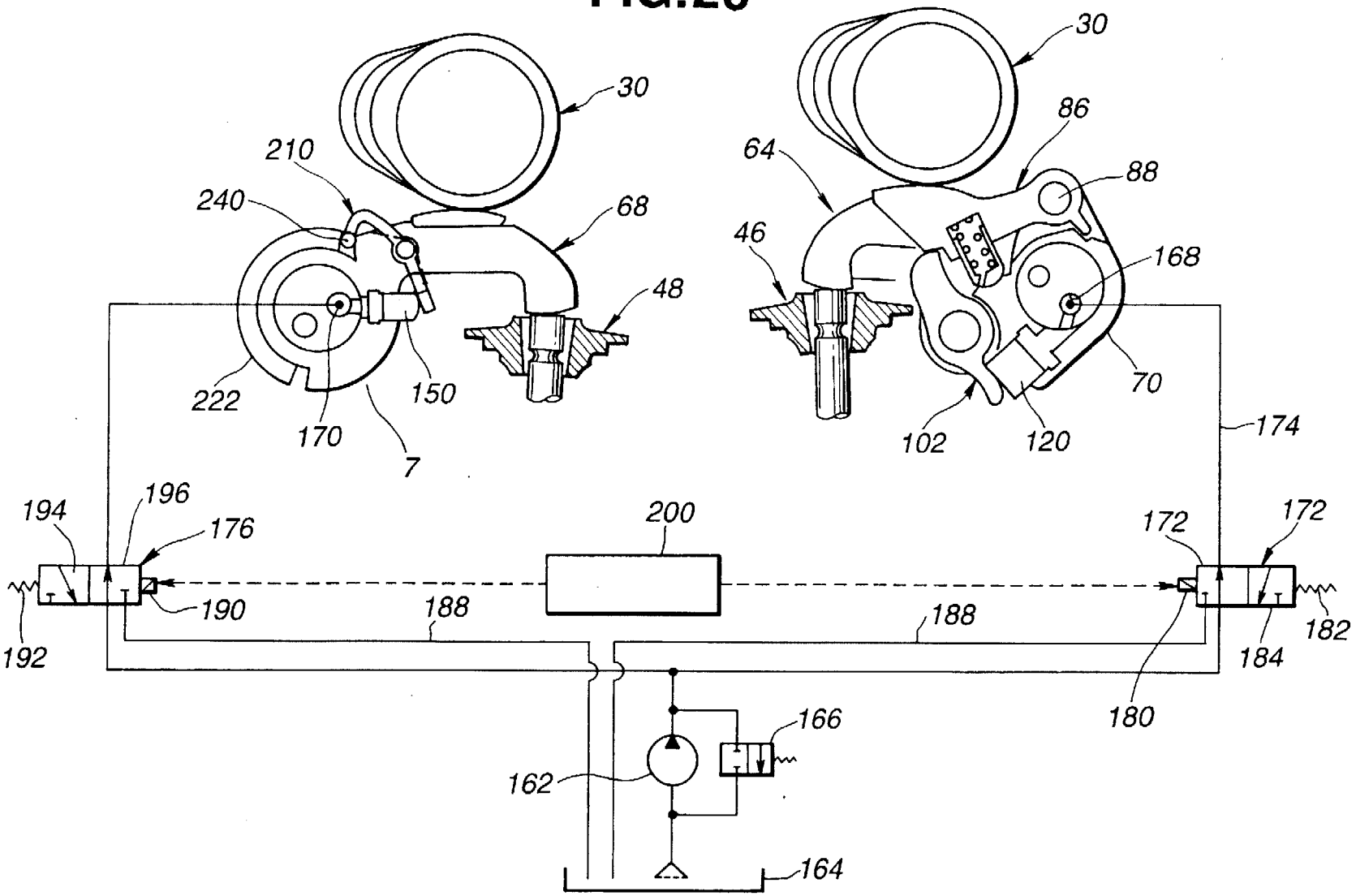
FIG. 25 is a hydraulic circuit of a driver for the third embodiment shown in FIGS. 12 to 15.

FIG. 25 is a preferred implementation of a driver for the first and second levers 102 and 210 of the third embodiment. This driver is substantially the same as the driver illustrated in FIG. 5 and thus detailed description is hereby omitted.

What is claimed is:

1. An apparatus for controlling cylinder valves for an internal combustion engine, comprising:

a first rocker arm pivotal about a rocker arm shaft axis, said first rocker arm being adapted for opening a first one of the cylinder valves;

a second rocker arm pivotal about said rocker arm shaft axis, said second rocker arm being adapted for opening a second one of the cylinder valves;

a free cam follower pivotal about a free cam follower axis that is spaced from and parallel to said rocker arm shaft axis, the free cam follower axis being stationary relative to said first rocker arm;

a first coupling selectively establishing a first drive connection between said free cam follower and said first rocker arm; and a second coupling selectively establishing a second drive connection between said first rocker arm and said second rocker arm.

2. An apparatus for controlling cylinder valves for an internal combustion engine, comprising:

a first rocker arm for opening a first one of the cylinder valves, said first rocker arm having a first hub supported on and being pivotal about a rocker arm shaft axis;

a second rocker arm for opening a second one of the valves, said second rocker arm having a second hub supported on and being pivotal about said rocker arm shaft axis;

a free cam follower being supported on said first hub and being pivotal about a free cam follower axis parallel to said rocker arm shaft axis, said free cam follower axis being stationary relative to said first rocker arm;

a first coupling selectively establishing a first drive connection between said free cam follower and said first rocker arm; and a second coupling selectively establishing a second drive connection between said first rocker arm and said second rocker arm.

3. An apparatus as claimed in claim 2, wherein said free cam follower has a prop including a plunger resting on said first hub of said first rocker arm and a lost motion spring between said plunger and said free cam follower.

4. An apparatus as claimed in claim 3, wherein said first coupling includes a first lever pivotal about a first lever axis stationary relative to said first rocker arm for pivotal motion, between a locked position thereof and a released position thereof, within a plane normal to said rocker arm shaft axis.

5. An apparatus as claimed in claim 4, wherein said first coupling further includes a first hydraulic piston, received in a first bore of said first rocker arm, serving as an actuator for said first lever.

6. An apparatus as claimed in claim 5, wherein said first coupling further includes a first compression spring received in a second bore of said first rocker arm.

7. An apparatus as claimed in claim 4, wherein said second coupling includes a second lever pivotal about a second lever axis stationary relative to said first rocker arm for pivotal motion between a locked position thereof and a released position thereof within another plane normal to said rocker arm shaft axis.

8. An apparatus as claimed in claim 7, wherein said second coupling includes a second hydraulic piston, received in a third bore of said first rocker arm, serving as an actuator for said second lever.

9. An apparatus as claimed in claim 8, further includes a second compression spring received in a fourth bore of said first rocker arm.

10. An apparatus as claimed in claim 7, wherein said second lever and said free cam follower are supported by a common shaft on said first rocker arm.

11. An apparatus as claimed in claim 7, wherein said first and second levers are supported by a common shaft on said first rocker arm.

12. An apparatus as claimed in claim 1, wherein said free cam follower has a bearing surface adapted to contact with a high lift cam, said second rocker arm has a bearing surface adapted to contact with a low lift cam, and said first rocker arm has a bearing surface adapted to contact with a middle lift cam, and wherein said free cam follower is disposed between said bearing surfaces of said first and second rocker arms.

13. An apparatus as claimed in claim 4, wherein said second coupling includes a second lever supported by said second rocker arm for pivotal motion between a locked position thereof and a released position thereof.

14. An apparatus as claimed in claim 13, wherein said second coupling further includes a second hydraulic piston, received in a bore of said second rocker arm, serving as an actuator.

15. An apparatus as claimed in claim 14, wherein said second coupling further includes a spiral spring anchoring at one end to said second rocker arm and at the opposite end to said second lever for biasing said second lever toward said released position thereof.

16. An apparatus as claimed in claim 15, wherein said first rocker arm includes a housing integral with said first hub and receiving said second hub.

17. An apparatus as claimed in claim 16, wherein said housing includes a collar and an end plate spaced by said collar from and opposed to said first hub, and wherein said collar interconnects said end plate and said first hub to define a cavity partially receiving said second hub.

18. An apparatus as claimed in claim 17, wherein said collar has a cylindrical wall partially defining said cavity, and wherein said second hub is recessed to define a cylindrical surface opposed to and cooperating with said cylindrical wall of said collar.

19. An apparatus as claimed in claim 18, wherein said second hub has a first shoulder and a second shoulder between which said cylindrical surface extends and wherein said collar has a first end spaced from said first shoulder of said second hub, and wherein said second lever has at one end thereof an ear engaged by said second hydraulic piston and at the opposite end thereof a bolt arranged to engage said first end of said collar.

20. An apparatus as claimed in claim 1, further comprising:

a camshaft with a high lift can cooperating with said free cam follower, a low lift cam cooperating with said second rocker arm, and a middle lift cam cooperating with said first rocker arm; and a driver rendering said first coupling operable to break a first drive connection between said free cam follower and said first rocker arm, and rendering said second coupling operable to break a second drive connection between said first and second rocker arms during engine operation at low speeds, said driver rendering said first coupling operable to break the first drive connection between said free cam follower and said first rocker arm, and rendering said second coupling operable to establish the second drive connection between said first and second rocker arms during engine operation at middle speeds higher than the low speeds, and said driver rendering said first coupling operable to establish the first drive connection between said free cam follower and said first rocker arm, and rendering said second coupling operable to establish the second drive connection between said first and second rocker arms during engine operation at high speeds higher than the middle speeds.

* * * * *